US006810953B2

(12) United States Patent
Adoline

(10) Patent No.: US 6,810,953 B2
(45) Date of Patent: Nov. 2, 2004

(54) SHOCK ABSORBER FOR OIL WELL PUMPING UNIT

(75) Inventor: Jack W. Adoline, Toledo, OH (US)

(73) Assignee: Barnes Group, Inc., Bristol, CT (US)

( * ) Notice: Subject to any disclaimer, the term of this patent is extended or adjusted under 35 U.S.C. 154(b) by 0 days.

(21) Appl. No.: 10/359,338

(22) Filed: Feb. 7, 2003

(65) Prior Publication Data

US 2004/0154791 A1 Aug. 12, 2004

(51) Int. Cl.[7] ..... E21B 33/03

(52) U.S. Cl. ..... 166/72; 166/69; 267/141; 267/153

(58) Field of Search ..... 166/72, 105, 68, 166/311, 69, 67; 267/141, 153; 74/41, 108

(56) References Cited

U.S. PATENT DOCUMENTS 4,176,714 A 12/1979 Case
4,346,620 A * 8/1982 Stanton ..... 74/583
4,354,397 A 10/1982 Fix
4,415,026 A * 11/1983 Rezewski et al. ..... 166/97.1
4,445,674 A 5/1984 Clayton, Jr.
4,665,761 A * 5/1987 Bao ..... 74/41
4,997,037 A * 3/1991 Coston ..... 166/105
6,446,946 B1 9/2002 Pelham

* cited by examiner

*Primary Examiner*—Frank Tsay
(74) *Attorney, Agent, or Firm*—Fay, Sharpe, Fagan, Minnich & McKee, LLP

(57) ABSTRACT

A shock absorber for use between the reciprocating member of an oil well pumping mechanism and a polish rod connected to the rod spring and movable along a vertical pumping axis. The shock absorber comprises an upper and lower end plate having a peripheral surface around the plumping axis and defining a polish rod clearance opening. A coil spring is located between the plates and is concentric with and surrounding the pumping axis. A friction reducing centering head secured to at least one of the plates (preferably the lower plates) centers polish rod in the clearance opening and holds the polish rod away from the peripheral wall of the plate.

78 Claims, 8 Drawing Sheets

SHOCK ABSORBER FOR OIL WELL PUMPING UNIT

The present invention relates to the art of oil pumping and more particularly to a shock absorber for use between the reciprocating member of an oil well pumping mechanism and a polish rod connected to the downwardly extending sucker rod string.

INCORPORATION BY REFERENCE

For many years in the oil industry some of the oil well pumping units have used a shock absorber between the polish rod and operating bridle of the reciprocating pumping mechanism. When employed, these shock absorbers were normally formed from elastomeric discs, such as shown in Case U.S. Pat. No. 4,176,714; Fix U.S. Pat. No. 4,354,397; and, Clayton U.S. Pat. No. 4,445,674. These patents are incorporated by reference as a disclosure of the background to which the present invention is directed. Such technology is well known and need not be repeated in this description of the invention. Recently it has been suggested to replace the elastomeric discs by a more reliable mechanism in the form of a coil spring as shown in Pelham U.S. Pat. No. 6,446,946, also incorporated by reference herein. By using a steel coil spring, long term deterioration and wear of the shock absorber itself is reduced. Control over movement of the polish rod is drastically improved. In Pelham U.S. Pat. No. 6,446,946 the coil spring is contained in a spring housing including two telescoping cylindrical cup-shaped members. The background and technology of using a single coil spring in a shock absorber as a replacement for the elastomeric discs is disclosed in this 2002 patent.

BACKGROUND OF INVENTION

Elastomeric shock absorbers shown in Case U.S. Pat. No. 4,176,714 have been very successful in reducing the peak loads imposed by the sucker rod string during the pumping action. However, elastomeric discs tend to wear and deteriorate during long term operation, especially in adverse environments. Consequently, recently there has been an effort to replace the elastomeric discs with a mechanical device in the form of a steel coil spring, as shown in Pelham U.S. Pat. No. 6,446,946. This newly developed technology is now in its infancy and has presented practical difficulties, such as undue wear between the polish rod and the lower end plate of the spring housing. This wear is accentuated when a spring pilot is provided in the bottom cylindrical housing member to center the coil spring. Such pilot has a center opening which contacts or engages the reciprocally movable polish rod to cause wear on the polish rod due to transverse forces. This metal-to-metal wear reduces the effective life of the shock absorber and requires periodic inspection and maintenance to assure continued operation of the shock absorber in the well pumping mechanism. The pilot needs to have a given axial height and must be formed from a hard material, such as hardened steel. Thus, there is an extended clearance opening inviting substantial wear and imposing new lifting force peaks. The advantages of using a coil spring over the elastomeric discs have not fully materialized in view of certain friction action experienced in present coil spring adaptation for a standard shock absorber between the lift bridle and polish rod. This disadvantage is overcome by the present invention so a coil spring shock absorber can provide its benefits without disadvantages of the Pelham effort.

THE INVENTION

To overcome the disadvantages associated with efforts to use a coil spring in the shock absorber between the reciprocal member of the well pumping mechanism and the polish rod, a shock absorber as shown in Pelham U.S. Pat. No. 6,446,946 has been modified to include a friction reducing centering head secured to the bottom and plate. In practice, a head is used at both the top end plate and the bottom end plate. These centering heads secured to the end plates center the polish rod in the clearance opening in the end plates and hold the polish rod away from the wall surrounding the clearance opening in the end walls. The spring pilot as shown on the lower end wall of Pelham U.S. Pat. No. 6,446,946 is replaced and made as a part of the centering head on the lower end plate so that the clearance opening is not extended for increased frictional engagement as necessary in the prior art. Lateral forces are decreased. The lower, or both end plates of the shock absorber, are provided with the centering mechanism that preferably includes a spring pilot to substantially reduce the friction experienced between the polish rod as it reciprocates in the shock absorber.

In accordance with the invention, a shock absorber for use between the reciprocating member of an oil well pumping mechanism and a polish rod connected to the downwardly extending rod string comprises an upper and lower end plate. Each end plate has a peripheral surface around the axis of the shock absorber to define a polish rod clearance opening between the two end plates. A coil spring is positioned between the end plates in a position concentric with, and surrounding, the reciprocal axis of the polish rod. Attachment members secure the lower plate with the reciprocal member of the well pumping mechanism. In accordance with the invention, a friction reducing centering head is secured to lower or both of the end plates for centering the polish rod as it passes through the clearance opening and for holding the polish rod away from the peripheral wall surrounding and defining the clearance opening. Thus, the clearance openings in the end plates, especially the one in the lower plate, are larger than the polish rod and a centering head engages the reciprocating polish rod with a mechanism to reduce the friction and wear between the reciprocating polish rod and the shock absorber.

In accordance with another aspect of the present invention, the coil spring has an inside diameter and the centering head includes a generally circular spring pilot secured to the end plate. This pilot has a center opening larger than but aligned with the clearance opening of the end plate and an outer diameter slightly smaller than the inner diameter of the coil spring. Thus, the centering head on each of the end plates perform the function of reducing friction, but also performs the function of guiding the coil spring. This guiding action occurs at both the upper end plate and the lower end plate. Consequently, the coil spring is guided in its axial movement during operation of the shock absorber. This is different than Pelham U.S. Pat. No. 6,446,946 wherein the spring aligner or pilot has an opening that is a mere extension of the lower plate clearance opening of the polish rod. This prior design increases the friction between the rod and the shock absorber. Thus, efforts to incorporate the advantages of the coil spring are met with frictional disadvantages. Furthermore, the prior art does not incorporate the advantage of a spring pilot on both reciprocating end plates to guide the main spring.

In accordance with another aspect of the present invention, the centering heads each have at least three guide rolls with rotating outer cylindrical surfaces that engage the polish rod and are mounted on the spring pilot. Thus, the polish rod extends through the large clearance opening in the end plates and is engaged with inwardly extending rotating cylindrical surfaces. These rolls may be elongated or relatively short in axial length. In practice, three circumferentially spaced guide rolls are preferred. The equally spaced guide rolls are rotatably mounted on a hardened pins to reduce the friction caused by engaging and rotating with the polish rod. In accordance with an aspect of the invention, the pins are hardened and the outer surface of the rollers engaging and centering the polish rod have a lower hardness than the hardness of the polish rod. This feature can not be used in the Pelham mechanism. Consequently, even the rolling action between the polish rod and the rolls does not damage or deteriorate the surface of the polish rod. The rolls have a low hardness compared to the polish rod. The pins are hardened steel that have a reduced rotational friction to be combined with a low rotational friction between the polish rod and the outer cylindrical surfaces of the circumferentially spaced rolls.

In the preferred embodiment of the present invention, the upper end plate of the shock absorber has a depending cylindrical body surrounding the coil spring and reciprocally received in an upstanding cylindrical body extending from the lower end plate. In still a further aspect, a second coil spring concentric with the first mentioned coil spring is provided in the shock absorber. In accordance with spring technology, the two springs have opposite coiled directions to prevent interleaving of the coil springs. The springs can have different free lengths so one spring provides the primary constant with other springs providing modified constants based upon the amount of force resisted by the spring combination. Use of two or more coil springs nested together allows correct spring rate at various deflections to optimize the deceleration rate of the shock absorber during the lifting action. The spring pilot associated with the centering head has an outer diameter to prevent the coil spring or inner coil spring from shifting with respect to the center axis of the pumping mechanism. When multiple springs are used, the inner, main spring guides the other spring or springs.

In accordance with another aspect of the present invention, the individual rolls in the centering head are radially adjustable to accommodate different diameter polish rods. Furthermore, one of the rolls is provided with an eccentric mounting mechanism which adjusts the clearance between the rolls and the reciprocating polish rod. In practice, an eccentric roll is provided on the centering head of both the top and bottom end plates. Of course, a single centering head could be used on the bottom end plate of the shock absorber where the most relative movement is created.

In accordance with another aspect of the invention a series of low friction elements, such as rollers are mounted on one cylindrical body of the spring housing to engage the other cylindrical body. This guides the two telescoped bodies as they reciprocate during pumping. This prevents undue wear and any binding between the moving components of the shock absorber.

The primary object of the present invention is the provision of an improved shock absorber for an oil well pump that dampens the peak load during pumping so the sucker rod and polish rod life is extended, as well as the life of the shock absorber. This shock absorber provides reduced wear on the pumping mechanism and the down hole pump.

Another object of the present invention is the provision of an improved shock absorber, as defined above, which shock absorber is used between the reciprocating pumping member of an oil well pumping mechanism and the string of sucker rods to reduce the peak load imposed on the sucker rod string during the pumping action and to increase the life of the shock absorber.

Still a further object of the present invention is the provision of a shock absorber, as defined above, which improved shock absorber utilizes one or more coil springs between the end plates as opposed to elastomeric discs as commonly used in the prior art to obtain the benefits of a coil spring.

A further object of the present invention is the provision of a shock absorber, as defined above, which shock absorber uses a centering head on the upper and lower end plates of the shock absorber whereby the polish rod clears the end plates and is engaged and centered by a separate low friction mechanism to thereby reduce the friction and increase the uniform and consistent performance of the pumping mechanism and the life of the shock absorber and polish rod.

These and other objects and advantages will become apparent from the following description taken together with the accompanying drawings.

PREFERRED EMBODIMENT

Figure 1:
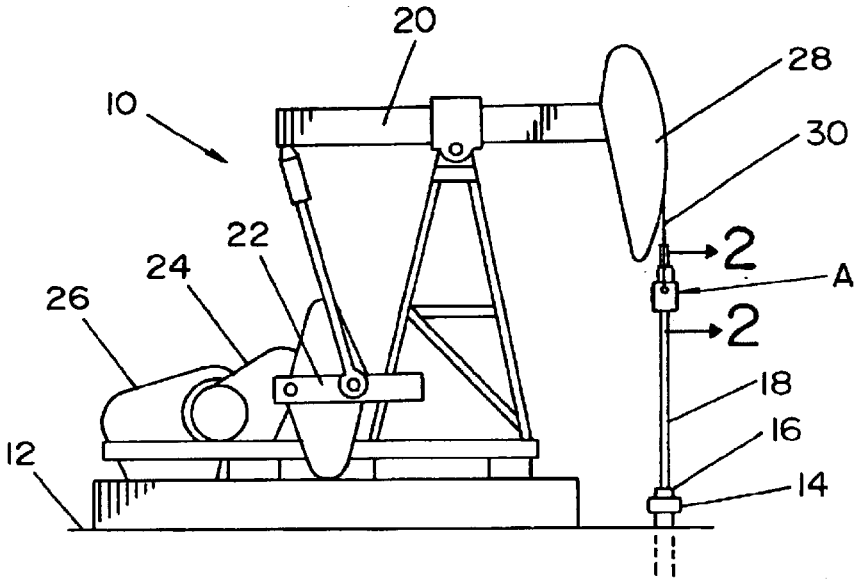
FIG. 1 is a schematic representation of an oil well pumping mechanism, shown in elevation, and illustrating the environment to which the present invention is utilized.

Referring now to the drawings wherein the showings are for the purpose of illustrating a preferred embodiment of the invention only and not for the purpose of limiting same, well pumping unit of mechanism 10 sits on earth surface 12 adjacent the upper end of a well casing 14 from which oil is pumped. At the top of casing 14 is stuffing box 16. Extending from the stuffing box is a polish rod 18 connected at its lower end to a string or line of sucker rods (not shown) which extend down into the well. At the lower end of the sucker rod string there is a reciprocal pump (not shown). The function of the pumping unit 10 is to exert reciprocal motion on the string of sucker rods to lift oil to the surface of the earth for flow from casing 14. Mechanism 10 is schematically illustrated and is shown as including cross beam 20 having connections at one end to crank arm 22 which is driven by gear train 24. The gear train is in turn driven by a rotary motion supplied from the output of prime mover 26, which is normally a gasoline engine. The other end of the cross beam has a horse head 28 from which is suspended a pair of spaced-apart cables 30 connected to a bridle formed by shock absorber A constructed in accordance with the present invention. Cables 30 are the ends of a single cable looped around horsehead 28. When an oil well pump does not use a shock absorber, polish rod 18 is secured directly to a bridle so that upon each upward reciprocation of horsehead 28 the polish rod 18 is lifted to lift the string of sucker rods attached to the polish rod. The submerged pump attached to the lower end of the sucker rod string forces a column of fluid from the bottom of the well. The apparatus so far described is a typical oil well pumping unit and forms no part of the present invention. In essence, the present invention is directed toward a shock absorber for coupling the reciprocal force applied by the pumping unit to the polish rod 18 to absorb the shock load spikes between these components. For this purpose a shock absorber constructed in accordance with the present invention is indicated as shock absorber A in FIG. 1.

In accordance with the invention, shock absorber A includes upper end plate 40 with a clearance opening 42 defined by a peripheral generally cylindrical wall 44 and a depending cylindrical body 46 extending from the end plate. A matching lower end plate 50 has a similar clearance opening 52 defined by peripheral wall 54 and an upstanding cylindrical body 56 reciprocally receiving body 46 to define a spring housing. Lower plate 50 is secured by attaching pins 58 with a cable connector 32 to form a bridle together with downwardly extending cables 30. In this manner, as horsehead 28 moves upwardly, cylindrical body 56 of shock absorber A is pulled upwardly by cables 30 to lift polish rod 18 from the well head. As horsehead 28 pivots downwardly, the polish rod is pulled downwardly by the weight of the rod string, which is several tons. Reciprocal movement of cables 30 pulls body 56 up or allows the body to be pulled downwardly by polish rod 18. To interconnect rod 18 with shock absorber A, standard rod clamp 60 clamps onto polish rod 18 by bolt 62. Shock absorber A is the connection between the rod and cables 30. This pumping action is along vertical axes a so coil spring 70, concentric with axis a, exerts a spring force between plates 40, 50. This force holds the weight of the sucker rod string. Spring 70 is compressed by the weight of the sucker rod string, as shown in FIG. 1. The operation of pumping mechanism 10 is described in Pelham U.S. Pat. No. 6,446,946. Cables 30 allow downward movement of polish rod 18 and then pulls the rod upwardly. In the prior art, clearance openings 42, 52 were frictionally engaged with polish rod 18 causing wear by a side force. There was less than uniform action over a long period due to the friction between the rod and one or more of the end plates.

Figure 2:
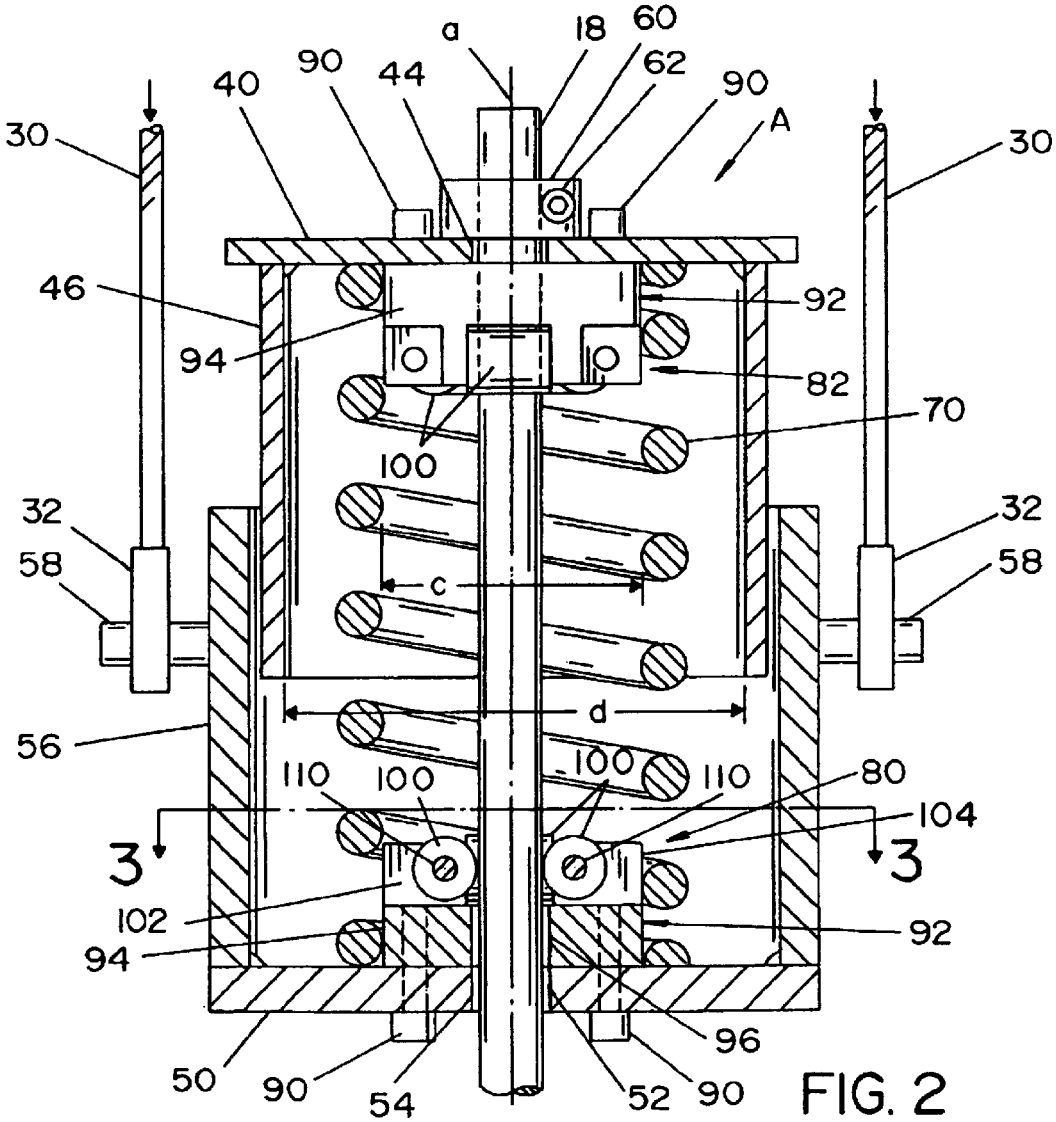
FIG. 2 is an enlarged cross-sectional view of a shock absorber constructed in accordance with the preferred embodiment of the invention.
Figure 3:
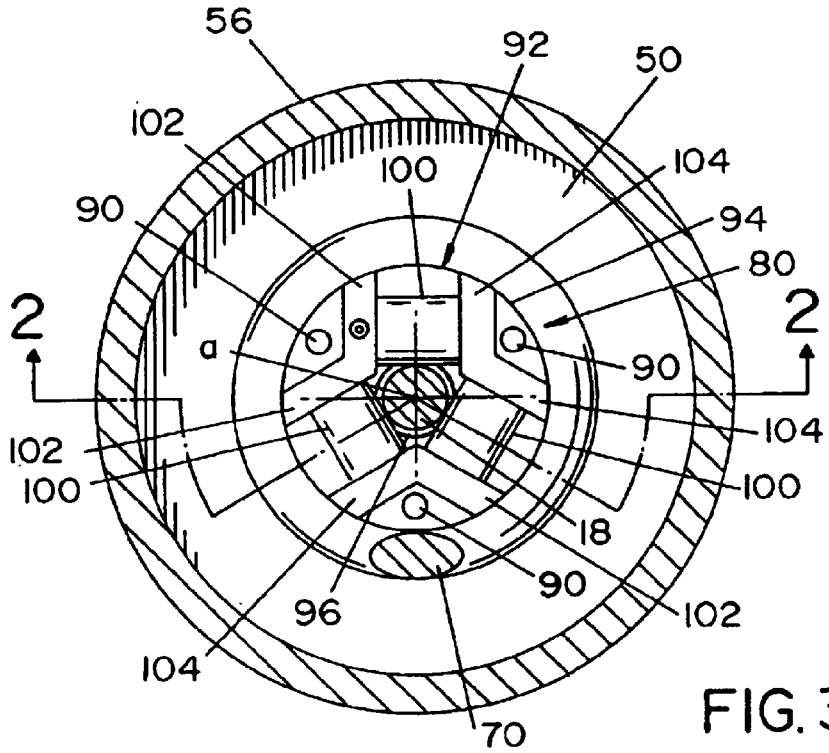
FIG. 3 is a cross-sectional view taken generally along line 3—3 of FIG. 2.
Figure 4:
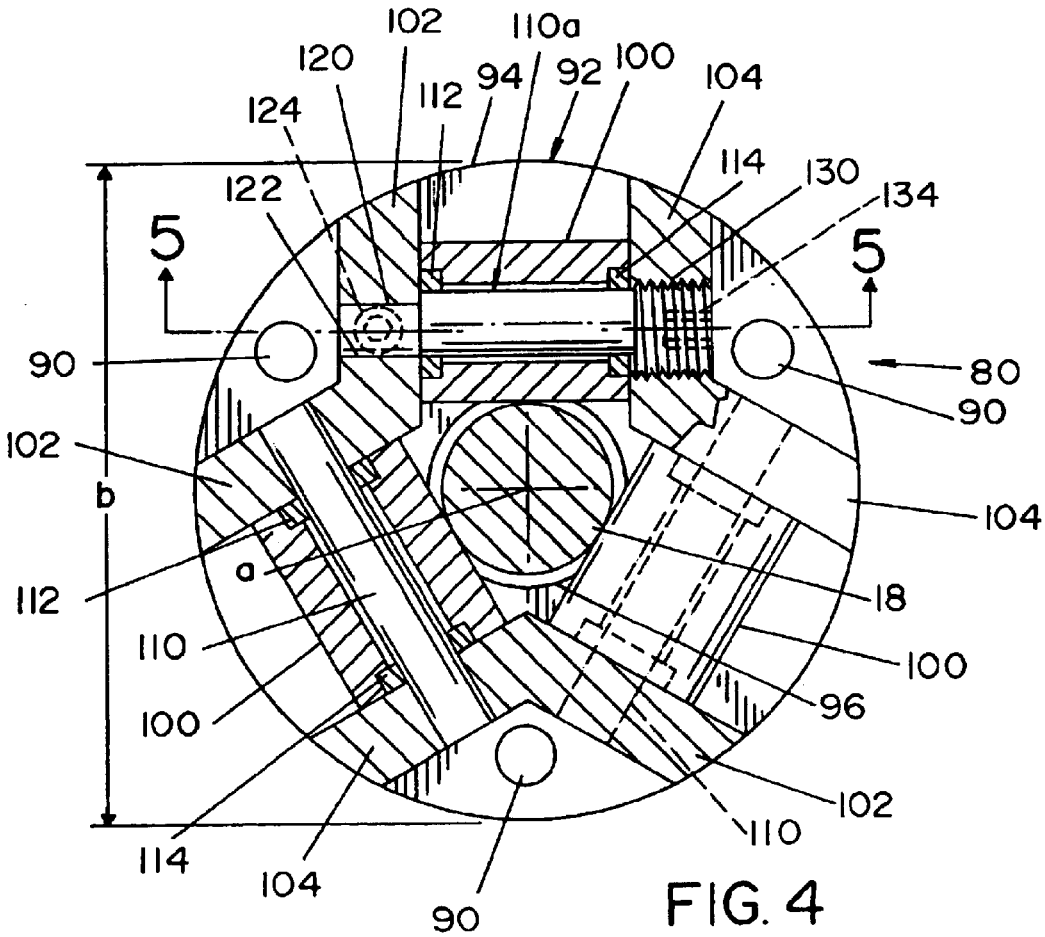
FIG. 4 is an enlarged view in cross-section taken generally along line 3—3 of FIG. 2 and showing in cross-section the eccentrically mounted roll.
Figure 5:
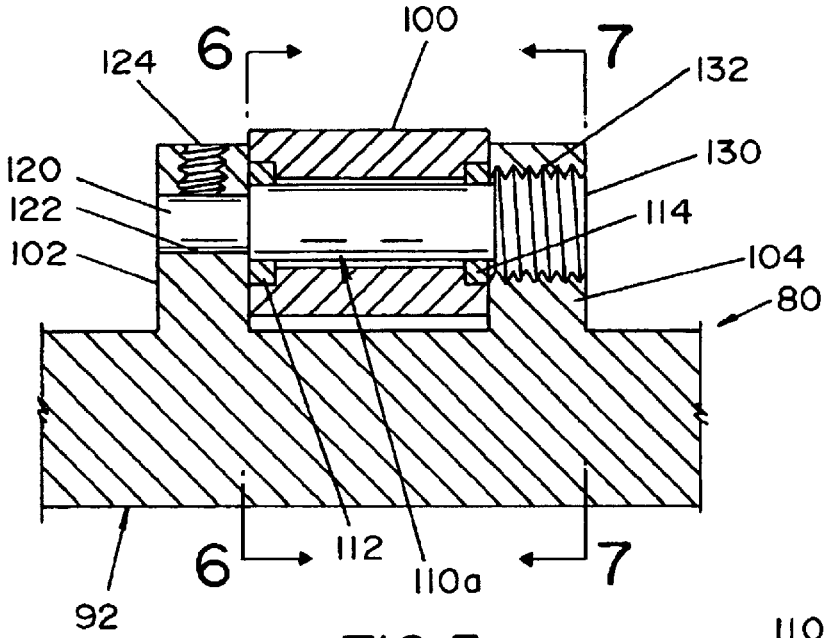
FIG. 5 is a cross-sectional view taken generally along line 5—5 of FIG. 4.
Figure 6:
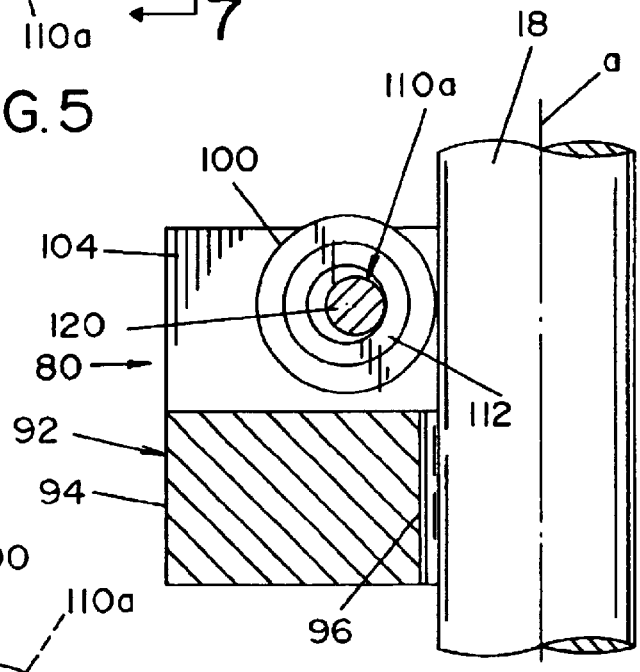
FIG. 6 is a partial enlarged view taken generally along line 6—6 of FIG. 5.
Figure 7:
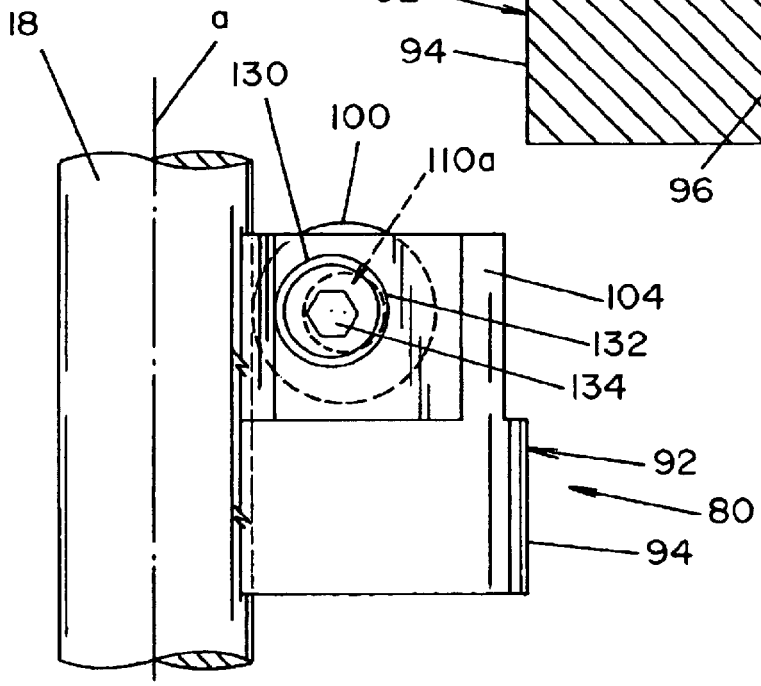
FIG. 7 is a partial enlarged view taken generally along line 7—7 of FIG. 5.
Figure 8:
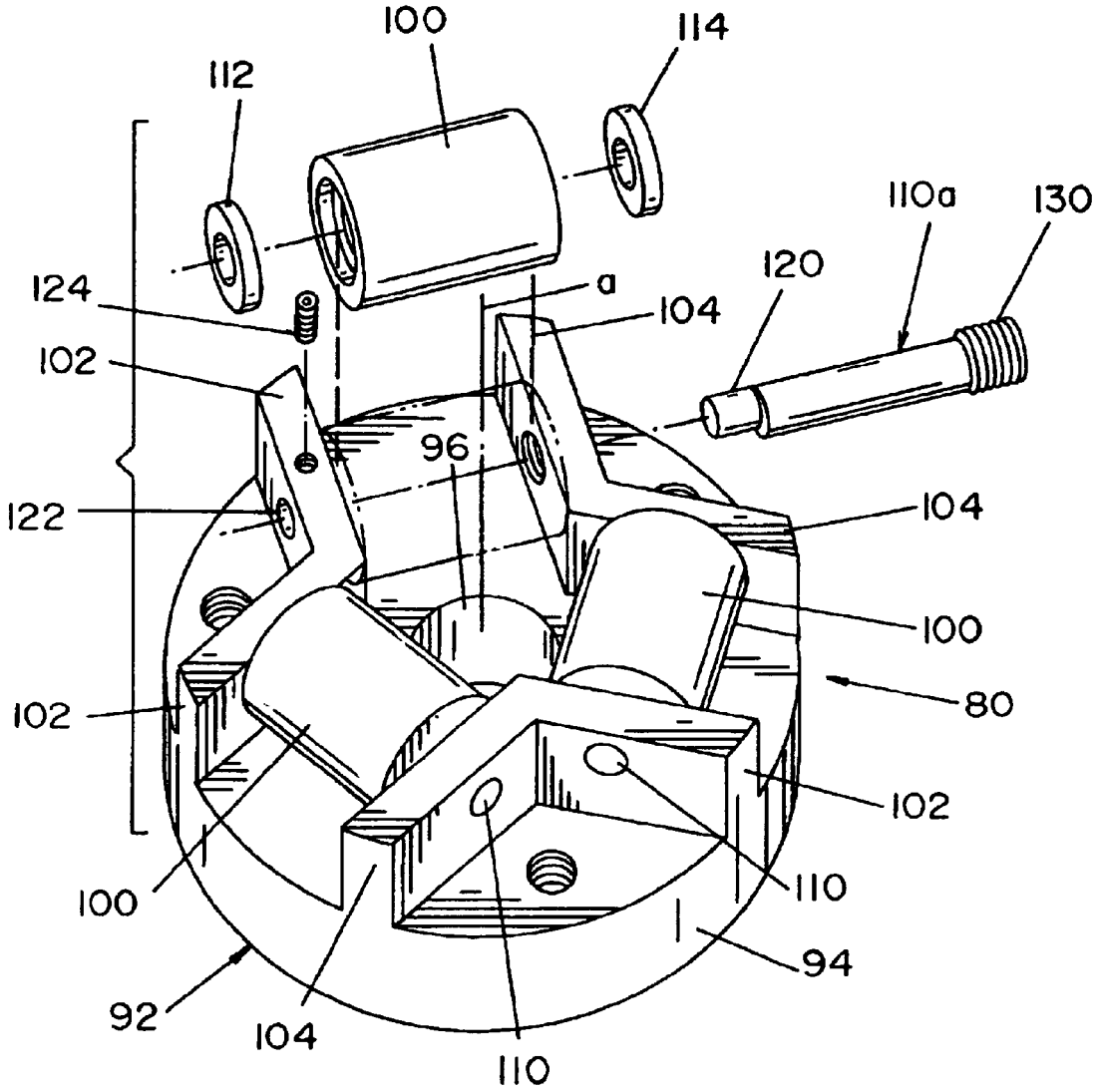
FIG. 8 is a pictorial view of a centering head used on the end plates in accordance with the present invention.

In accordance with the present invention, clearance openings 42, 52 are substantially larger in diameter than the polish rod 18. The rod is engaged at plates 40, 50 by friction reducing centering heads 80, 82, respectively. Consequently, centering heads 80, 82 prevent contact between polish rod 18 and the clearance openings in end plates 40, 50. The lower head 50 is the more active friction reducing component. However, it is preferred to use both heads 80, 82. Thus, it is anticipated by the present invention that only a single friction reducing center head 80 be employed in shock absorber A. In such a mechanism, upper clearance opening 42 has a diameter generally matching the polish rod as in the prior art. In the preferred embodiment as shown in FIGS. 2-4, there are two centering heads.

However, only the lower centering head 80 will be described in detail and this description will apply to upper centering head 82. Head 80 is secured to its end plate by a series of spaced bolts 90. These bolts extend into the body of the head 80, which is in the form of a coil spring pilot 92 with an outer cylindrical wall 94 having a diameter b, indicated in FIG. 4. Center opening 96 of pilot 92 is larger in diameter than rod 18 and generally matches the clearance opening of the end plates. Coil spring 70 has an internal diameter c, as indicated in FIG. 2. This internal spring diameter is slightly greater than the outer diameter of wall 94. In practice, the difference between the diameters is in the general range of 0.05–0.30 inches. Also in practice, the internal diameter d of cylindrical body 46 is not as widely spaced from coil spring 70 as shown in FIG. 2. In practice, this spacing is in the general range of 0.30–1.00 inches when multiple springs are used, the spacing accommodates the spring stack. Thus, the pilots 92 of heads 80, 82 and the inner surface of cylindrical body 46 guide the operation of string 70 along axes a.

In accordance with the primary feature of present invention, head 80 contacts rod 18 at three circumferentially spaced locations in a manner to provide low friction between the spring shock absorber and the rod. To accomplish this objective, the preferred embodiment includes three rolls 100 supported by hardened pins 110 on circumferentially spaced trunnion sets each with trunnions 102, 104. As shown best in FIG. 4, pins 110 extend through roll 100 between trunnions 102, 104. In practice, the hardened pins extend outwardly from the trunnions and receive snap rings to retain the hardened steel pins in the trunnions. Rolls 100 have an outer surface of material softer than the hardness of the steel of rod 18. Pins 110 are hardened steel and employ solid bearings 112, 114 for rotatably mounting a roll 100. As so far described, pins 100 engage rod 18. As the rod moves vertically with respect to an end plate, rolls 100 engaging the rod rotate. This rotary action causes substantially lower friction than direct sliding contact of the rod with the end plates in Pelham U.S. Pat. No. 6,446,946. In the prior art shock absorber, the end plates are formed from hardened steel; therefore, the inner surface of the clearance opening sliding along the reciprocating polish rod has a hardness at least equal to and maybe greater than the hardness of the polish rod surface. This hard surface against hard surface increases wear, increases friction and prevents smooth operation of the oil pump. The present invention uses rotating rolls that provide a soft surface engaging the rod and a lower friction rotary motion to allow the reciprocal action between the end plates and the rod. This low friction allows a pump to employ the tremendous advantage of using a steel coil spring in the shock absorber. The coil spring has a spring constant that accommodates the pumping action. This action is not obtainable by merely providing a stack of elastomeric discs. By changing the size and material of coil spring 70, the upper plate can support the total weight of the sucker rod string and still have sufficient travel to provide a shock absorbing action. Thus, the use of centering heads 80, 82 allows the implementation of a coil spring in a shock absorber with the advantages of the coil spring, without the disadvantages apparent in the prior art shown in Pelham U.S. Pat. No. 6,446,946.

In accordance with an aspect of the invention, at least one roll 100 on the centering head 80 is mounted by an eccentric mechanism to allow slight adjustment of the roll or rolls toward and away from rod 18. This concept is shown in FIGS. 4-8 wherein the mechanism uses pin 110 between one trunnion 102, 104 modified to use pin 110*a*. This pin has an outer end 120 with a rotary axis offset from the roll axis of pin 10*a*. End 120 is locked in bore 122 of trunnion 102 by set screw 124. To change the inward position of roll 100 on pin 110*a*, set screw 124 is loosened. End 130 of modified pin 110*a* is threadably received in bore 132*a* and has an Allen wrench receptacle 134. After set screw 124 has been released, pin 110*a* is rotated by inserting a tool into receptacle 134 for rotating pin 110*a*. This shifts roll 100 on pin 110*a* toward and away from rod 18. Other arrangements could be used for eccentrically mounting one or more of the rotating centering rolls on head 80.

Figure 9:
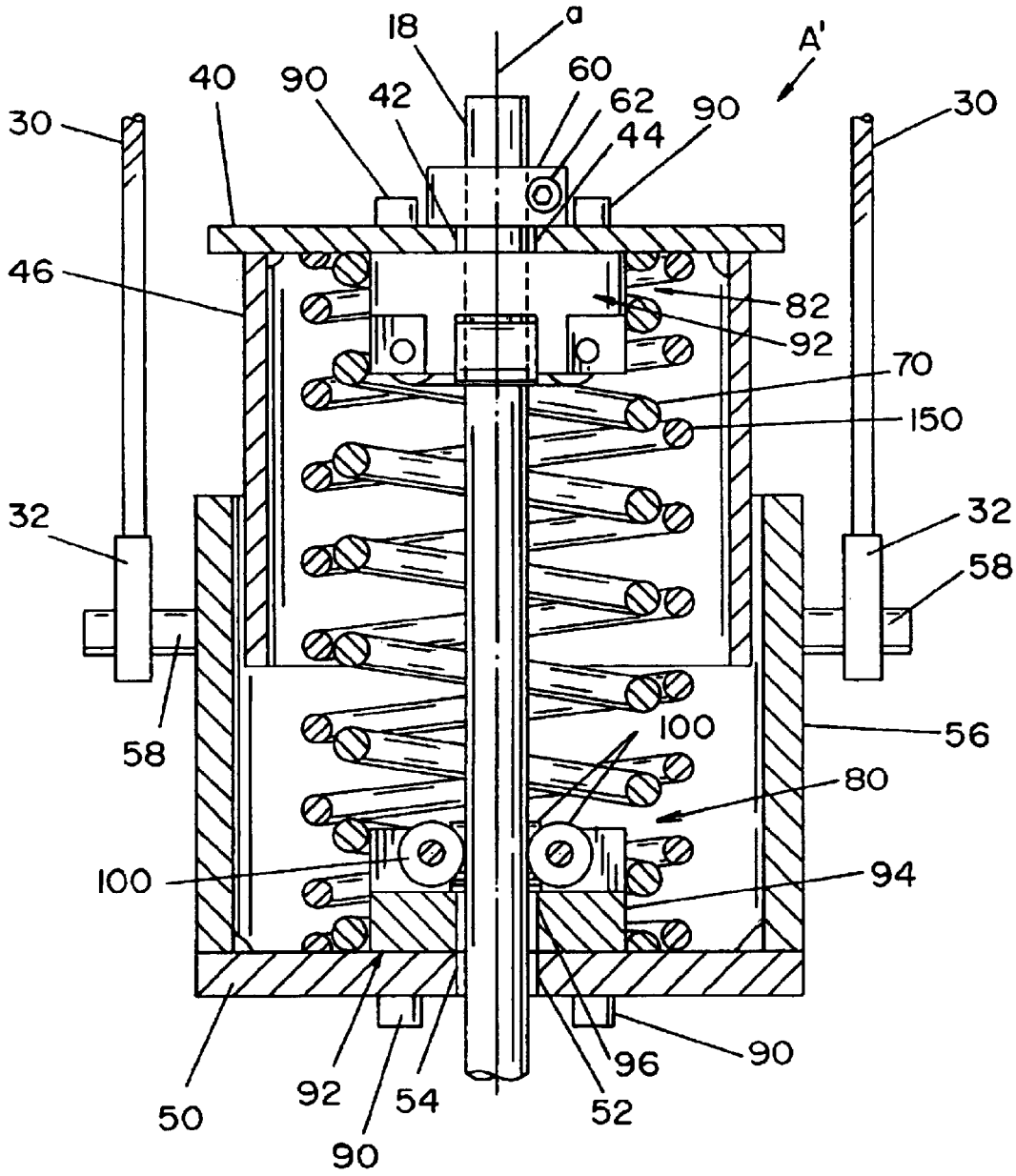
FIG. 9 is a view, similar to FIG. 2, illustrating multiple coil springs for adjusting the vertical spring constant of the shock absorber.

In FIG. 9, a modified shock absorber A' is illustrated. The same structure used in shock absorber A as so far disclosed is used in shock absorber A'; however, spring 70 is surrounded by concentric coil spring 150. This coil spring has an opposite direction of winding to prevent interleaving of the coil springs. The spring constant of springs 70, 150 are combined to provide the optimum deceleration rate between end plates 40, 50. In practice, spring 70 has a free length greater than spring 150 so the action of spring 150 comes after extensive compression of spring 70. In FIG. 9 both springs are compressed as is the situation during operation of shock absorber A'. Wall 94 of the centering head locates spring 70. This main spring locates outer secondary spring 150 in a fixed controlled concentric relationship. Thus, the operation of the two springs is coordinated to produce the desired shock absorbing action especially during lifting of the sucker rod string. The length of spring 150 determines when it becomes active as a combined spring constant.

Figure 10:
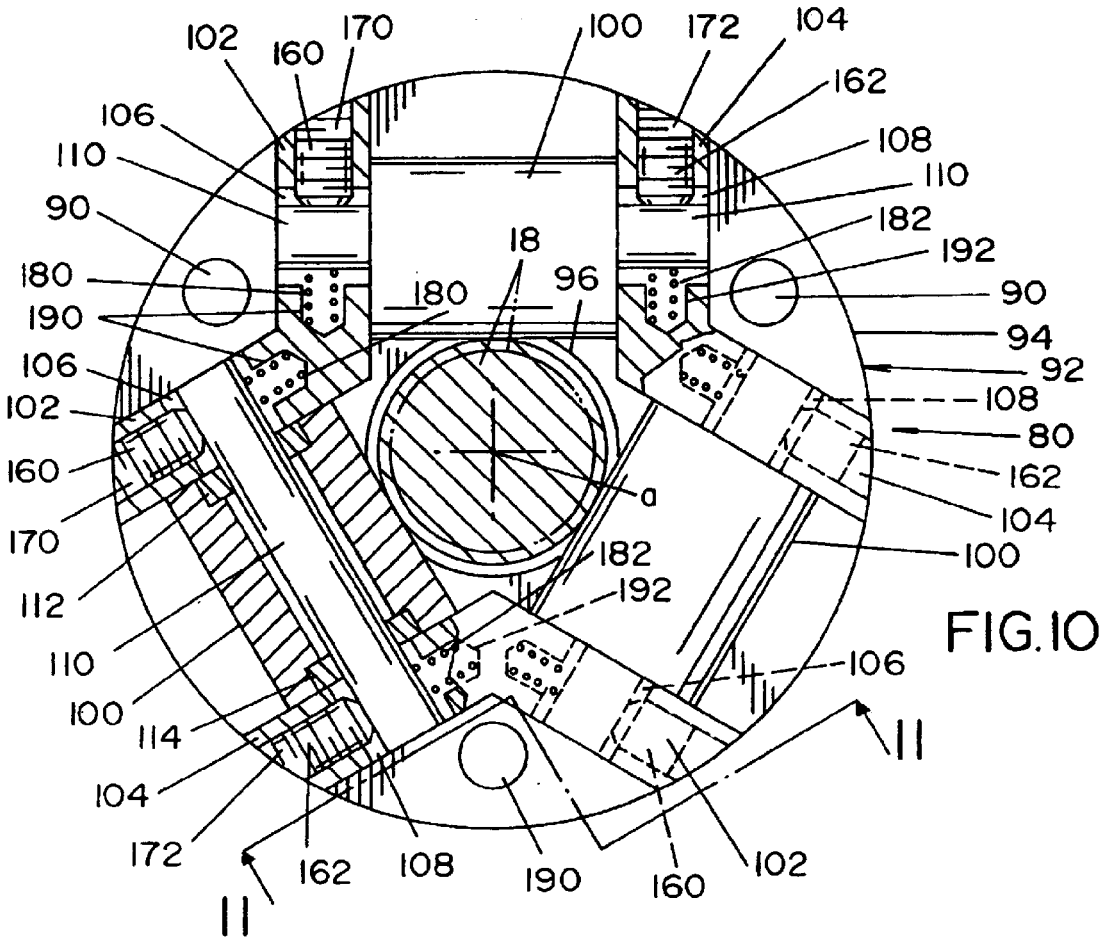
FIG. 10 is an enlarged plan view showing the three rolls with radial adjusting mechanisms to move the rolls toward and away from the polish rod.
Figure 11:
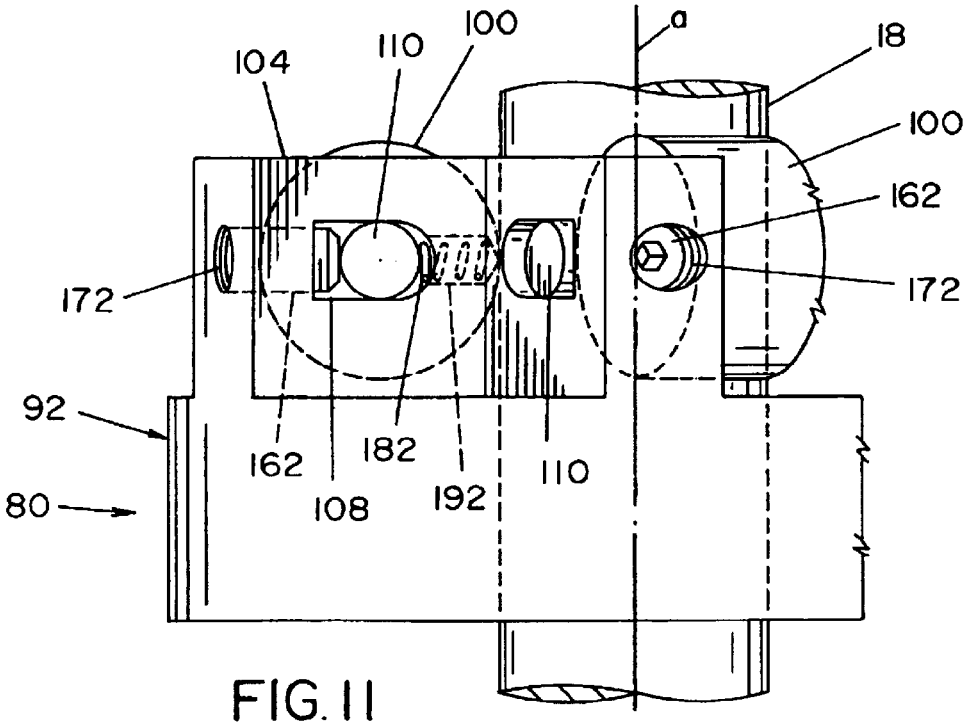
FIG. 11 is an enlarged side view of one trunnion provided for axial adjustment of the rolls shown in FIG. 10.

In practice, shock absorber A is designed for accommodating various polish rod diameters. In FIG. 10 a large rod is shown in solid lines and a smaller rod is shown in dashed lines. To adjust centering heads 80, 82, as shown in FIG. 1, to accommodate different diameter polish rods, in the embodiment of the invention shown in FIG. 10, rolls 100 are radially adjustable by an appropriate mechanism. This mechanism is shown as elongated slots 106, 108 in trunnions 102, 104, respectively. Slots 106, 108 receive the outer ends of pin 100 so that the pin is moved in the slots in a direction toward and away from pumping axis a. Set screws 160, 162 in trunnions 102, 104, respectively establish the outermost position of pin 110. These set screws are threaded in bores 170, 172 machined in the spaced trunnions. Take up springs 180, 182 are mounted in bores 190, 192 to bias pin 110 toward set screws 160, 162. The set screws adjust the inward position of rolls 100 to accommodate various sizes of polish rods. Other arrangements could be used to adjust the radial position of the various rolls in centering heads 80, 82. It is not essential that such adjustment be provided; however, it shall be used in practice.

Figure 12:
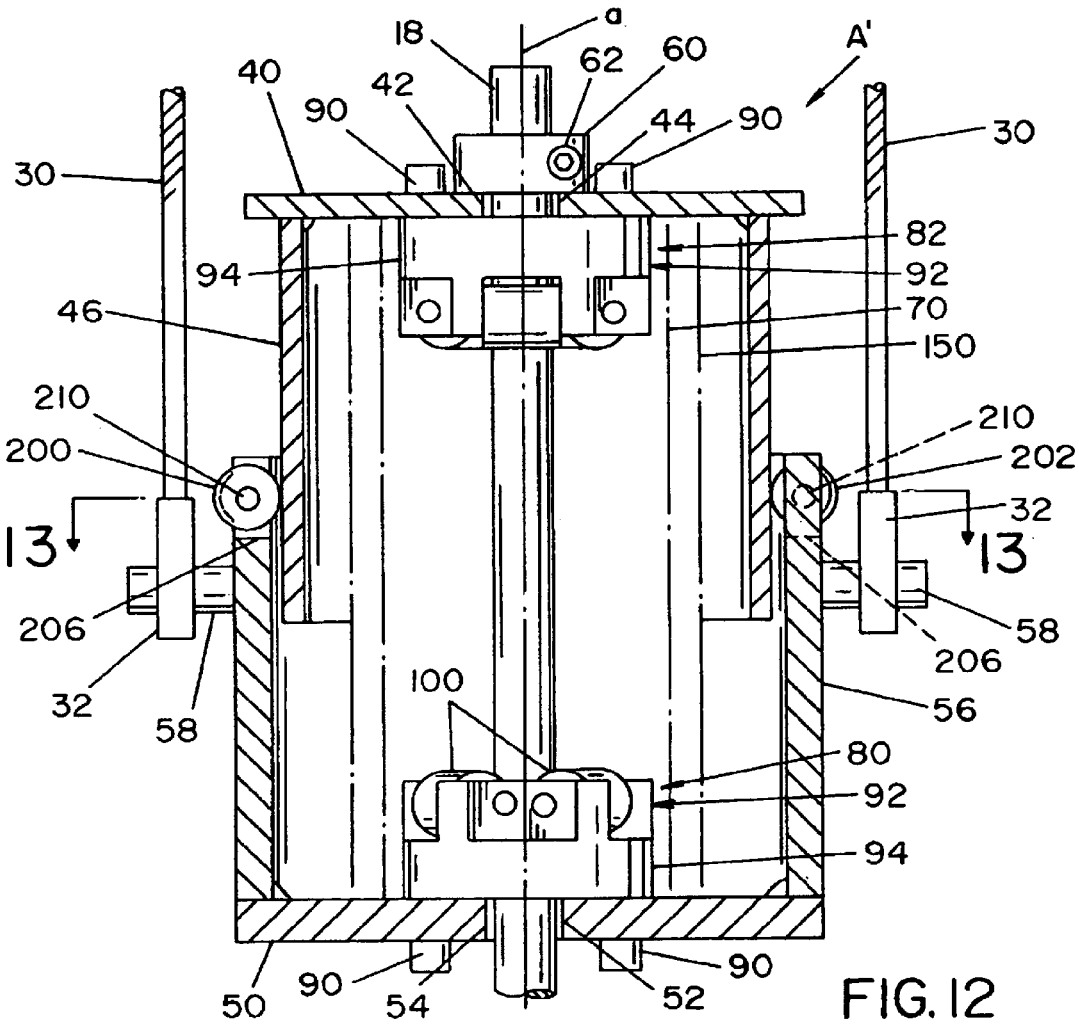
FIG. 12 is a cross-sectional view like FIG. 2 showing an embodiment with rolls between the cylinder bodies of the spring housing.
Figure 13:
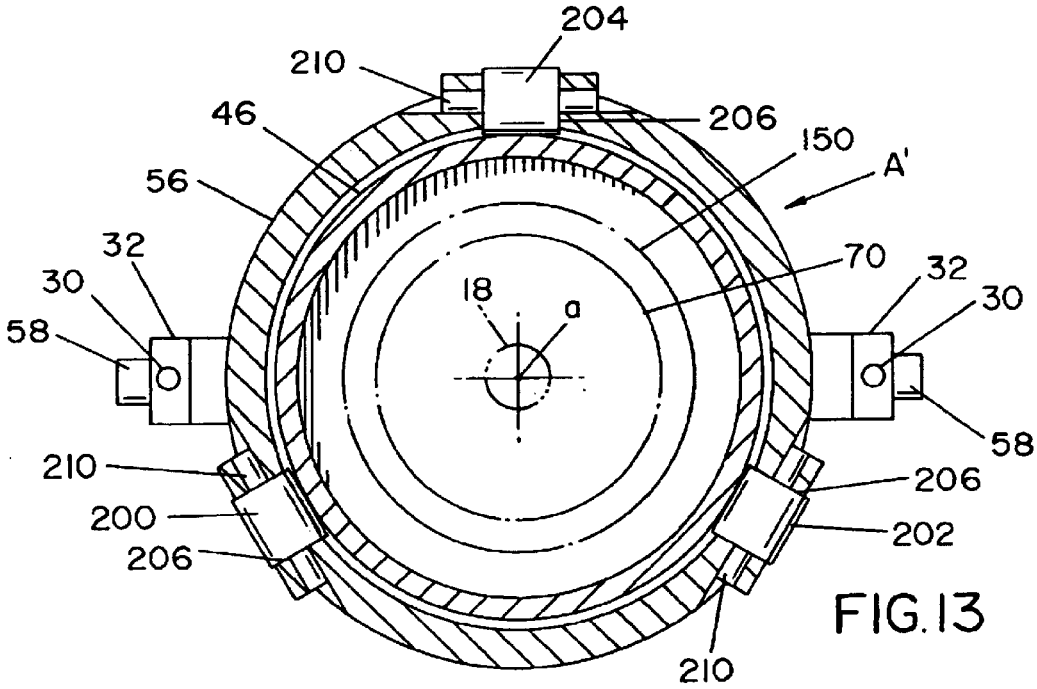
FIG. 13 is a cross-sectional view taken generally along line 13—13 of FIG. 12; and, FIG. 14 is a cross-sectional view like FIG. 9 showing an embodiment with three coil springs and exhibiting the different free lengths of the springs.
Figure 14:
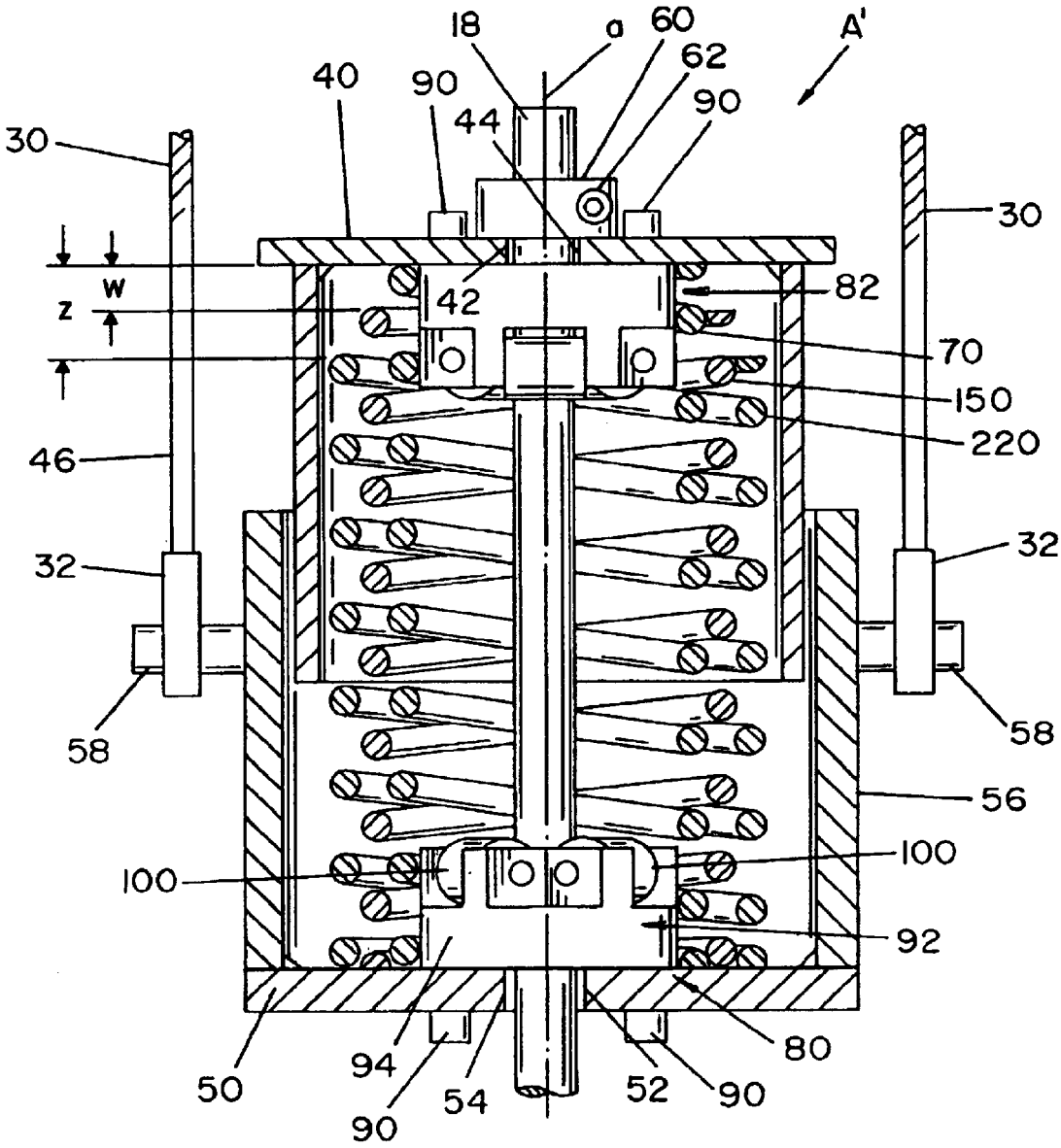

Referring now to the embodiment of FIGS. 12–13, shock absorber A', as previously described, has like numbers for like parts. However, the illustrated embodiment assures stability of the reciprocal action between bodies 46, 56 by provision of intermediate, circumferentially spaced low friction elements 200, 202 and 204 illustrated as rollers rotatably mounted in slots 206 of body 56 by pins 210. In this embodiment, rollers 200, 202 and 204 fill the space or gap between the reciprocating bodies; but, create only low friction between the bodies. A spacing element, such as a roller with a hardness less than the hardness of body 46 is preferred. These rollers are equally spaced around the bodies to assure free vertical movement during the operation of shock absorber A'. Other low friction elements could be used between the bodies for this stated purpose. Indeed, more than three low friction elements could be employed. Shock absorber A' in FIG. 9 is further modified as illustrated in FIG. 14 where the like parts include like numbers. In this further modification of the shock absorber, a third spring 220 surrounds main springs 70 and secondary spring 150. Outer spring 220 is coiled in the direction opposite to the direction of spring 150, but in the same direction as main spring 70. The embodiment of FIG. 14 exhibits that the use of additional springs each of which usually employs springs having different free lengths. In the illustration, secondary spring 150 is shorter than main spring 70 by distance w. In a like manner, the height of spring 220 is less than the height of spring 70 by distance z. All springs are compressed during operation of the shock absorber. Thus, the distances w, z are explanatory in nature merely to show that the secondary two coils in a multiple coil shock absorber are tailored to exert less force when basic or main spring 70 has been deflected a greater amount. In practice, springs 70, 150 and 210 are in the compressed condition during operation of the shock absorber. The difference in heights of the coils allows difference in the reaction to force spikes to assure a smooth pumping action, especially when cables 30 raise the shock absorber and the polish rod.

In the embodiments illustrated, two centering heads are illustrated. The upper centering head may not be necessary since rod 18 does not move substantially with respect to the upper end plate 40. However, smooth operation of rod 18 with respect to plate 40, is assured by an upper centering head.

Having thus defined the invention, the following is claimed:

1. In a shock absorber for use between the reciprocating member of an oil well pumping mechanism and a polish rod connected to rod string and movable along a vertical pumping axis, said shock absorber including a spring housing comprising a first upper cylinder concentric with said axis and with a top wall having a clearance opening for said polish rod and aligned with said axis, and a second lower cylinder reciprocally receiving said first cylinder with a bottom wall having a clearance opening for said polish rod and aligned with said axis; a coil spring in said housing between said top wall and bottom wall; and, an attachment element between said lower cylinder and said reciprocating member, the improvement comprising: a centering head over the clearance openings of at least one of said walls, said centering head having at least three guide rolls with cylindrical surfaces engaging said polish rod and holding said polish rod away from said at least one wall.

2. The improvement as defined in claim 1 wherein said spring has an inside diameter and said centering head includes a generally circular pilot plate secured to the wall of said at least one opening, said plate having center opening aligned with said clearance opening and an outer diameter slightly smaller than inside diameter of said spring for centering said spring, said guide rolls being rotatably mounted on said pilot plate.

3. The improvement as defined in claim 2 wherein said rolls are formed from a material softer than said polish rod engaged by said rolls.

4. The improvement as defined in claim 3 wherein said rolls are each rotatably mounted on a pin.

5. The improvement as defined in claim 4 wherein said pins are formed from hardened steel.

6. The improvement as defined in claim 4 wherein said pins are mounted for adjustment toward said polish rod.

7. The improvement as defined in claim 2 wherein said rolls are each rotatably mounted on a pin.

8. The improvement as defined in claim 7 wherein said pins are formed from hardened steel.

9. The improvement as defined in claim 7 wherein said pins are mounted for adjustment toward said polish rod.

10. The improvement as defined in claim 2 wherein a like constructed centering head is secured over the clearance opening of the other of said walls.

11. The improvement as defined in claim 1 wherein said rolls are formed from a material softer than said polish rod engaged by said rolls.

12. The improvement as defined in claim 11 wherein said rolls are each rotatably mounted on a pin.

13. The improvement as defined in claim 12 wherein said pins are formed from hardened steel.

14. The improvement as defined in claim 12 wherein said pins are mounted for adjustment toward said polish rod.

15. The improvement as defined in claim 11 wherein a like constructed centering head is secured over the clearance opening of the other of said walls.

16. The improvement as defined in claim 1 wherein said rolls are each rotatably mounted on a pin.

17. The improvement as defined in claim 16 wherein said pins are formed from hardened steel.

18. The improvement as defined in claim 16 wherein said pins are mounted for adjustment toward said polish rod.

19. The improvement as defined in claim 18 wherein at least one of said pins is mounted in an eccentric mechanism for adjustment with respect to said polish rod.

20. The improvement as defined in claim 16 wherein a like constructed centering head is secured over the clearance opening of the other of said walls.

21. The improvement as defined in claim 1 wherein a like constructed centering head is secured over the clearance opening of the other of said walls.

22. In a shock absorber for use between the reciprocating member of an oil well pumping mechanism and a polish rod connected to rod string and movable along a vertical pumping axis, said shock absorber including a spring housing comprising a first upper cylinder concentric with said axis and with a top wall having a clearance opening for said polish rod and aligned with said axis, and a second lower cylinder reciprocally receiving said first cylinder with a bottom wall having a clearance opening for said polish rod and aligned with said axis; a coil spring in said housing between said top wall and bottom wall; and, an attachment element between said lower cylinder and said reciprocating member, the improvement comprising: a centering head over the clearance openings of at least one of said walls, said centering head having at least three guide rolls with cylindrical surfaces engaging said polish rod and holding said polish rod away from said at least one wall; said rolls are each rotatably mounted on a pin, wherein said pins are formed from hardened steel, wherein said pins are mounted for adjustment toward said polish rod.

23. The improvement as defined in claim 22 wherein said spring has an inside diameter and said centering head includes a generally circular pilot plate secured to the wall of said at least one opening, said plate having center opening aligned with said clearance opening and an outer diameter slightly smaller than inside diameter of said spring for centering said spring, said guide rolls being rotatably mounted on said pilot plate.

24. The improvement as defined in claim 23 wherein said rolls are formed from a material softer than said polish rod engaged by said rolls.

25. In a shock absorber for use between the reciprocating member of an oil well pumping mechanism and a polish rod connected to rod string and movable along a vertical pumping axis, said shock absorber including a spring housing comprising a first upper cylinder concentric with said axis and with a top wall having a clearance opening for said polish rod and aligned with said axis, and a second lower cylinder reciprocally receiving said first cylinder with a bottom wall having a clearance opening for said polish rod and aligned with said axis; a coil spring in said housing between said top wall and bottom wall; and, an attachment element between said lower cylinder and said reciprocating member, the improvement comprising: a centering head over the clearance openings of at least one of said walls, said centering head having at least three guide rolls with cylindrical surfaces engaging said polish rod and holding said polish rod away from said at least one wall; wherein said rolls are each rotatably mounted on a pin; wherein at least one of said pins is mounted in an eccentric mechanism for adjustment with respect to said polish rod.

26. In a shock absorber for use between the reciprocating member of an oil well pumping mechanism and a polish rod connected to rod string and movable along a vertical pumping axis, said shock absorber including a spring housing comprising a first upper cylinder concentric with said axis and with a top wall having a clearance opening for said polish rod and aligned with said axis, and a second lower cylinder reciprocally receiving said first cylinder with a bottom wall having a clearance opening for said polish rod and aligned with said axis; a coil spring in said housing between said top wall and bottom wall; and, an attachment element between said lower cylinder and said reciprocating member, the improvement comprising: a centering head over the clearance openings of at least one of said walls, said centering head having at least three guide rolls with cylindrical surfaces engaging said polish rod and holding said polish rod away from said at least one wall;

wherein said spring has an inside diameter and said centering head includes a generally circular pilot plate secured to the wall of said at least one opening, said plate having center opening aligned with said clearance opening and an outer diameter slightly smaller than inside diameter of said spring for centering said spring, said guide rolls being rotatably mounted on said pilot plate, wherein said rolls are each rotatably mounted on a pin, wherein at least one of said pins is mounted in an eccentric mechanism for adjustment with respect to said polish rod.

27. The improvement as defined in claim 26 wherein a like constructed centering head is secured over the clearance opening of the other of said walls.

28. In a shock absorber for use between the reciprocating member of an oil well pumping mechanism and a polish rod connected to rod string and movable along a vertical pumping axis, said shock absorber including a spring housing comprising a first upper cylinder concentric with said axis and with a top wall having a clearance opening for said polish rod and aligned with said axis, and a second lower cylinder reciprocally receiving said first cylinder with a bottom wall having a clearance opening for said polish rod and aligned with said axis, a coil spring in said housing between said top wall and bottom wall, and, an attachment element between said lower cylinder and said reciprocating member, the improvement comprising: a centering head over the clearance openings of at least one of said walls, said centering head having at least three guide rolls with cylindrical surfaces engaging said polish rod and holding said polish rod away from said at least one wall;

wherein said spring has an inside diameter and said centering head includes a generally circular pilot plate secured to the wall of said at least one opening, said plate having center opening aligned with said clearance opening and an outer diameter slightly smaller than inside diameter of said spring for centering said spring, said guide rolls being rotatably mounted on said pilot plate, wherein said rolls are each rotatably mounted on a pin, wherein said pins are mounted for adjustment toward said polish head;

wherein a like constructed centering head is secured over the clearance opening of the other of said walls.

29. A shock absorber for use between the reciprocating member of an oil well pumping mechanism and a polish rod connected to the rod string and movable along a vertical pumping axis, said shock absorber comprising upper and lower end plates each having a peripheral surface around said axis and defining a polish rod clearance opening, a coil spring between said plates and concentric with and surrounding said axis, attachment members secured to said lower plate for attachment of said lower plates to said reciprocating member and a friction reducing centering head secured to said upper and lower end plates for centering said polish rod in said clearance opening and holding said polish rod away from said peripheral wall.

30. A shock absorber as defined in claim 29 wherein said coil spring has an inside diameter and said centering head includes a generally circular spring pilot secured to the at least one wall, said pilot having a center opening aligned with said clearance opening and an outer diameter slightly smaller than the inside diameter of said coil spring.

31. A shock absorber as defined in claim 30 wherein said centering head has at least three guide rolls with cylindrical surfaces engaging said polish rod.

32. The improvement as defined in claim 31 wherein said rolls are formed from a material softer than said polish rod engaged by said rolls.

33. The improvement as defined in claim 31 wherein said pins are mounted for adjustment toward said polish rod.

34. The improvement as defined in claim 31 wherein at least one of said pins is mounted in an eccentric mechanism for adjustment with respect to said polish rod.

35. A shock absorber as defined in claim 31 wherein a like constructed centering head is secured over the clearance opening of said end plates.

36. A shock absorber as defined in claim 35 wherein said upper end plate has a depending cylindrical body around said spring and reciprocally received in an upstanding cylindrical body extending from said lowered end plate.

37. A shock absorber as defined in claim 30 wherein a like constructed centering head is secured over the clearance opening of said end plates.

38. A shock absorber as defined in claim 37 wherein said upper end plate has a depending cylindrical body around said spring and reciprocally received in an upstanding cylindrical body extending from said lowered end plate.

39. A shock absorber as defined in claim 37 including a second coil spring concentric with said first mentioned coil spring, but coiled in the opposite direction.

40. A shock absorber as defined in claim 39 wherein said second coil spring has a free length different than said first coil spring.

41. A shock absorber as defined in claim 30 wherein said upper end plate has a depending cylindrical body around said spring and reciprocally received in an upstanding cylindrical body extending from said lowered end plate.

42. A shock absorber as defined in claim 41 including a second coil spring concentric with said first mentioned coil spring, but coiled in the opposite direction.

43. A shock absorber as defined in claim 42 wherein said second coil spring has a free length different than said first coil spring.

44. A shock absorber as defined in claim 41 including a series of low friction elements on one of said cylindrical bodies and between said bodies to stabilize reciprocal action between said bodies.

45. A shock absorber as defined in claim 44 wherein said low friction elements are rollers.

46. A shock absorber as defined in claim 30 including a second coil spring concentric with said first mentioned coil spring, but coiled in the opposite direction.

47. A shock absorber as defined in claim 46 wherein said second coil spring has a free length different than said first coil spring.

48. A shock absorber as defined in claim 29 wherein said centering head has at least three guide rolls with cylindrical surfaces engaging said polish rod.

49. The improvement as defined in claim 48 wherein said rolls are formed from a material softer than said polish rod engaged by said rolls.

50. A shock absorber as defined in claim 48 wherein a like constructed centering head is secured over the clearance opening of said end plates.

51. A shock absorber as defined in claim 50 wherein said upper end plate has a depending cylindrical body around said spring and reciprocally received in an upstanding cylindrical body extending from said lowered end plate.

52. A shock absorber as defined in claim 29 wherein a like constructed centering head is secured over the clearance opening of said end plates.

53. A shock absorber as defined in claim 52 wherein said upper end plate has a depending cylindrical body around said spring and reciprocally received in an upstanding cylindrical body extending from said lowered end plate.

54. A shock absorber as defined in claim 52 including a second coil spring concentric with said first mentioned coil spring, but coiled in the opposite direction.

55. A shock absorber as defined in claim 54 wherein said second coil spring has a free length different than said first coil spring.

56. A shock absorber as defined in claim 29 wherein said upper end plate has a depending cylindrical body around said spring and reciprocally received in an upstanding cylindrical body extending from said lowered end plate.

57. A shock absorber as defined in claim 56 including a second coil spring concentric with said first mentioned coil spring, but coiled in the opposite direction.

58. A shock absorber as defined in claim 57 wherein said second coil spring has a free length different than said first coil spring.

59. A shock absorber as defined in claim 56 including a series of low friction elements on one of said cylindrical bodies and between said bodies to stabilize reciprocal action between said bodies.

60. A shock absorber as defined in claim 59 wherein said low friction elements are rollers.

61. A shock absorber as defined in claim 29 including a second coil spring concentric with said first mentioned coil spring, but coiled in the opposite direction.

62. A shock absorber as defined in claim 61 wherein said second coil spring has a free length different than said first coil spring.

63. A shock absorber for use between the reciprocating member of an oil well pumping mechanism and a polish rod connected to the rod string and movable along a vertical pumping axis, said shock absorber comprising upper and lower end plates each having a peripheral surface around said axis and defining a polish rod clearance opening, a coil spring between said plates and concentric with and surrounding said axis, attachment members secured to said lower plate for attachment of said lower plates to said reciprocating member and a friction reducing centering head secured to at least one of said plates for centering said polish rod in said clearance opening and holding said polish rod away from said peripheral wall; wherein said centering head has at least three guide rolls with cylindrical surfaces engaging said polish rod wherein said pins are mounted for adjustment toward said, polish rod.

64. The improvement as defined in claim 63 wherein said rolls are formed from a material softer than said polish rod engaged by said rolls.

65. A shock absorber as defined in claim 63 wherein a like constructed centering head is secured over the clearance opening of said end plates.

66. A shock absorber as defined in claim 63 wherein said upper end plate has a depending cylindrical body around said spring and reciprocally received in an upstanding cylindrical body extending from said lowered end plate.

67. A shock absorber as defined in claim 63 including a second coil spring concentric with said first mentioned coil spring, but coiled in the opposite direction.

68. A shock absorber as defined in claim 63 including a series of low friction elements on one of said cylindrical bodies and between said bodies to stabilize reciprocal action between said bodies.

69. A shock absorber as defined in claim 63 wherein said low friction elements are rollers.

70. A shock absorber as defined in claim 63 wherein said second coil spring has a free length different than said first coil spring.

71. A shock absorber for use between the reciprocating member of an oil well pumping mechanism and a polish rod connected to the rod string and movable along a vertical pumping axis, said shock absorber comprising upper and lower end plates each having a peripheral surface around said axis and defining a polish rod clearance opening, a coil spring between said plates and concentric with and surrounding said axis, attachment members secured to said lower plate for attachment of said lower plates to said reciprocating member and a friction reducing centering head secured to at least one of said plates for centering said polish rod in said clearance opening and holding said polish rod away from said peripheral wall; wherein said centering head has at least three guide rolls with cylindrical surfaces engaging said polish rod; wherein at least one of said pins is mounted in an eccentric mechanism for adjustment with respect to said polish rod.

72. The improvement as defined in claim 71 wherein said rolls are formed from a material softer than said polish rod engaged by said rolls.

73. A shock absorber as defined in claim 71 wherein a like constructed centering head is secured over the clearance opening of said end plates.

74. A shock absorber as defined in claim 71 wherein said upper end plate has a depending cylindrical body around said spring and reciprocally received in an upstanding cylindrical body extending from said lowered end plate.

75. A shock absorber as defined in claim 71 including a second coil spring concentric with said first mentioned coil spring, but coiled in the opposite direction.

76. A shock absorber as defined in claim 71 including a series of low friction elements on one of said cylindrical bodies and between said bodies to stabilize reciprocal action between said bodies.

77. A shock absorber as defined in claim 71 wherein said low friction elements are rollers.

78. A shock absorber as defined in claim 71 wherein said second coil spring has a free length different than said first coil spring.

* * * * *